United States Patent [19]

Yeazel

[11] Patent Number: 4,976,187

[45] Date of Patent: Dec. 11, 1990

[54] FAST SWEEP POWER CYLINDER FOR REFUSE TRUCKS

[75] Inventor: Kenneth L. Yeazel, Tulsa, Okla.

[73] Assignee: Crane Carrier Company, Tulsa, Okla.

[21] Appl. No.: 236,043

[22] Filed: Aug. 24, 1988

[51] Int. Cl.[5] ..... F01B 7/20

[52] U.S. Cl. ..... 91/173; 91/512; 91/516; 91/519; 92/52; 92/53

[58] Field of Search ..... 91/519, 514, 511, 512, 91/516, 517, 173; 92/53, 51, 52; 100/48, 50, 229 A

[56] References Cited

U.S. PATENT DOCUMENTS

| | | | |
|---|---|---|---|
| 2,517,153 | 8/1950 | Wood | 121/46 |
| 3,114,296 | 12/1963 | Smith, Jr. | 91/169 |
| 3,128,674 | 4/1964 | Ganchar | 91/167 R |
| 3,302,535 | 2/1967 | Procter et al. | 92/52 |
| 3,415,169 | 12/1968 | Maddell | 92/85 |
| 3,610,100 | 10/1971 | Hoffman | 91/167 |
| 3,760,689 | 9/1973 | Johnston | 91/519 |
| 3,832,937 | 9/1974 | Moore et al. | 91/167 |
| 3,960,059 | 6/1976 | Schexnayder | 91/461 |
| 4,057,010 | 11/1977 | Smith | 91/519 |
| 4,112,823 | 9/1978 | Liberman et al. | 91/36 |
| 4,349,305 | 9/1982 | Wynn et al. | 91/516 |
| 4,691,617 | 9/1987 | Purkott | 91/167 |
| 4,700,623 | 10/1987 | Durbin et al. | 100/52 |
| 4,726,281 | 2/1988 | De Filippi | 91/167 |

*Primary Examiner*—Edward K. Look
*Assistant Examiner*—John E. Ryznic
*Attorney, Agent, or Firm*—Head & Johnson

[57] ABSTRACT

Power fluid from a pump are provided through one power fluid branch conduit to an extend port for activating the smallest cylinder of a multi-stage packing cylinder and fluid is conducted through a second extend branch conduit to a second port which provides fluids to the larger cylinders of the packing cylinder. A normally closed sequence value is in the second branch conduit. When the pump first is activated, fluid goes through the first extend branch conduit to extend the smallest stage of the packing cylinder. When the smallest stage is fully extended or reaches resistance, the pressure in the pump output conduit rises. When this pressure reaches a preselected value, the sequence valve is opened and high pressure fluid is directed through the second branch conduit and second port to provide power fluid to the larger cylinders of the packing cylinder.

1 Claim, 1 Drawing Sheet

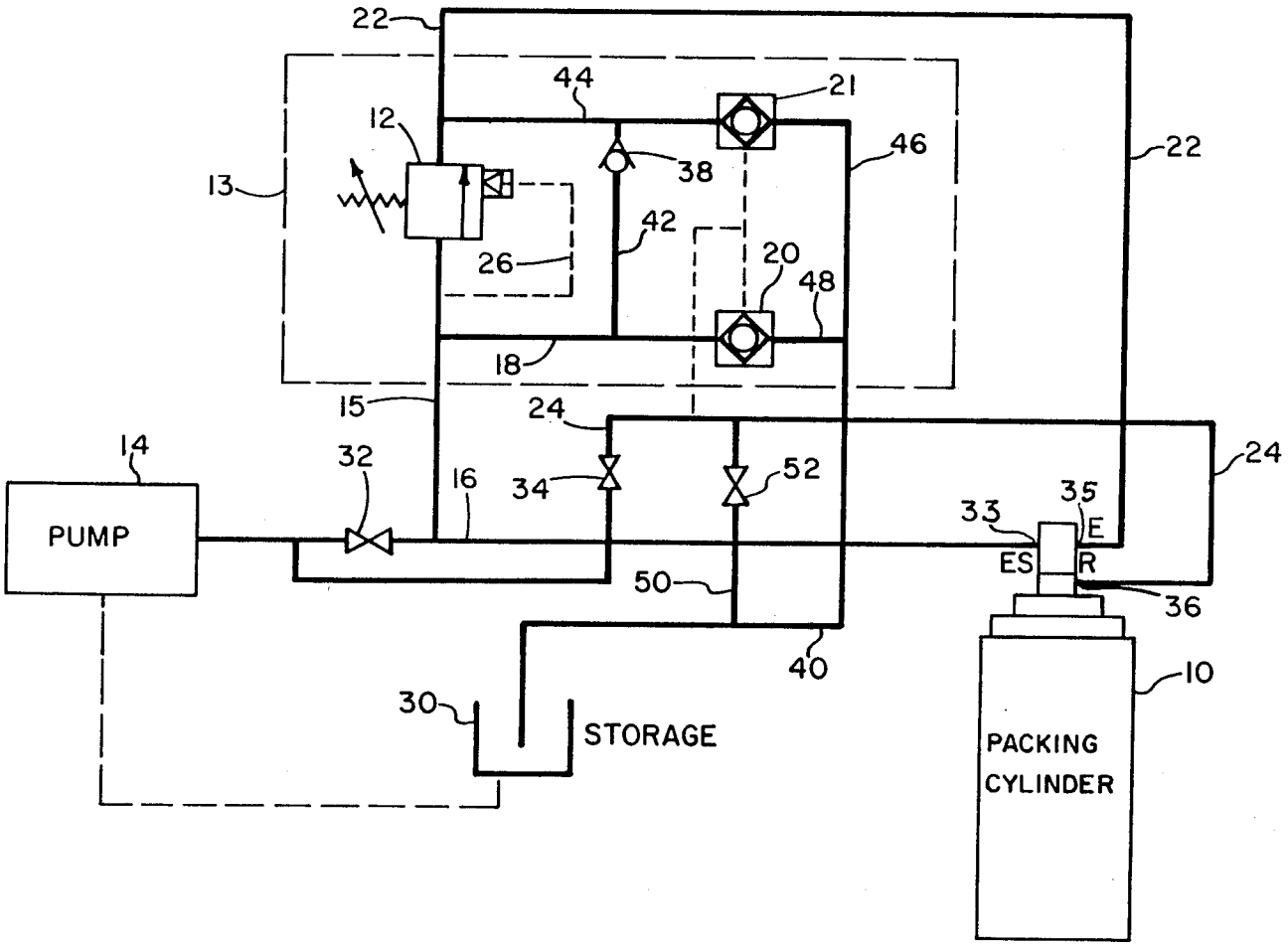
PACKING CYLINDER
STORAGE
PUMP
E
R
ES
10
12
13
14
15
16
18
20
21
22
24
26
30
32
33
34
35
36
38
40
42
44
46
48
50
52

FAST SWEEP POWER CYLINDER FOR REFUSE TRUCKS

BACKGROUND OF THE INVENTION

This invention relates to the compaction of trash by a compaction blade in a refuse truck. It more particularly relates to the use of a multi-stage packing cylinder in extending the compaction blade.

Refuse or garbage collection trucks are widely used to collect trash, garbage and so forth and transport it to a disposal site. These refuse trucks are commonly driven down the streets of this country. The refuse is deposited inside a can, bin or container of a truck. In order to carry more refuse per trip, compaction blades are provided to compact the refuse in the bin. The blade is normally in an at rest or retracted position as the trash is dumped into the bin. Normally, a hydraulic multi-stage packing cylinder unit (having a plurality of concentric telescoping cylinders) is used to shove the compaction blade until it compresses the refuse in the bin. The cylinder is normally a multi-stage cylinder, e.g., four or five stages. It may be provided with two extend ports, one is an ES port which is used to provide fluid to the smallest or the two smaller cylinders and the other port is an E port which is used to provide power fluid to the remaining cylinder of the packing cylinder unit which are the larger cylinders. The packing cylinder unit is also provided with a retract port which is connected to a return conduit to carry the fluid on the non-power side of the concentric cylinders back to a storage tank. Hydraulic fluid is provided from a pump and is diverted manually to the extend ports when it is desired to compact the trash. When it is desired to retract the compaction blade, the power fluid is directed to the retract port or R of the packing cylinder unit and causes the concentric cylinders to go in the opposite direction retracting the compaction blade.

This works quite well, however, it does have certain disadvantages. For example, the time required for extending the stages of the cylinders is rather long.

Because of this problem I have concluded that there is a need for improving the speed of the extension of the compaction blade. It is an object of this invention to provide such a system.

SUMMARY OF THE INVENTION

The fast sweep of this invention is a system for use on refuse vehicle whereby the packer or compaction blade is advanced in a shorter time than what has previously been done. The packer blade is extended and retracted by use of a "packing cylinder" unit which normally is made up of five or six stages or concentric cylinders. The term "packing cylinder unit" means the total unit of the nesting concentric cylinders. The packing cylinder unit has an ES port which is used for connecting power fluid to the smallest or two smallest concentric cylinders of the packing cylinder unit. The packing cylinder also has an E port which is used to introduce power fluid to the concentric cylinders not provided with power fluid by the ES port. Thus, the E port would provide power to the larger concentric cylinders. The packing cylinder unit also has an R port which is connected to a conduit which returns fluid to a storage reservoir when the packing cylinder unit is being extended. When it is desired to retract the various concentric cylinders of the packing cylinder unit power fluid is introduced through the R port and the ES port and the E port are connected to conduit means for returning the fluid to the reservoir storage.

A pump is provided with an output which is connected to an extend power conduit with a valve therein which may be opened and closed. The extend power conduit is connected to a first extend branch conduit and a second extend branch conduit. The first extend branch conduit is connected directly to the ES port. The extend power conduit is also connected to a second extend branch conduit which is connected to the E port. However, the second extend branch conduit is provided with a sequence control valve which is a normally closed valve and is provided with means to open it when the pressure in the second extend branch between the extend valve and the pump reaches a preselected level. At the time such pressure reaches this level, the sequence valve is opened and remains opened as long as the pressure exceeds the selected value.

In operations, when the packer is to be extended the pump fluid is directed into the extend power conduit and the power fluid is directed only to the ES port inasmuch as the sequence valve is closed. This causes the smaller or one of the smaller concentric cylinders to be activated and that concentric cylinder will extend until it reaches full extension (normally about 48 inches) or until the resistance of the load causes the system pressure in the first extend branch conduit to rise to above the selected value which is the pressure setting of the sequence valve. When the extend pressure has risen above the setting of the sequence valve setting (normally 800 to 1200 psi), the sequence valve is opened and fluid is also directed then from the pump to the E port. This causes the larger concentric cylinders to start to extend. The concentric cylinders will continue to extend until fully extended.

It takes a much higher pressure to extend the larger stages or concentric cylinders of the packing cylinder than it does the smaller concentric cylinders. Thus, the lower initial pressure will extend the smaller concentric cylinders but not the larger ones.

The retraction of the cylinder from the fully extended position is obtained by closing the valve which leads from the retract conduit to the storage and opening a valve which connects the retract conduit to the pump and at the same time closing the valve which leads from the pump to the extend branch conduits.

BRIEF DESCRIPTION OF THE DRAWINGS

FIG. 1 shows a flow diagram including a sequence valve assembly which is used for extending and retracting the concentric cylinders of the packing cylinder unit.

DETAILED DESCRIPTION OF THE INVENTION

Attention is now directed to the drawing which shows a hydraulic flow diagram of my invention. Shown thereon is a multi-stage packing power cylinder unit 10. In the drawing there are indicated five stages or concentric cylinders, however, there may be various numbers. This is the type packing cylinder unit which is widely used to extend the blade when it is desired to compress the refuse. It is also used to retract the blade back to its starting position in integrated refuse vehicle. A suitable multi-stage cylinder unit is commercially available from Great Bend Industries, Great Bend, Kans. This packing cylinder unit has a first extend port 33 designated ES which is connected to the two smaller concentric cylinders of a typically five stage unit and a port 35 designated E which is connected to provide power fluid to all the other concentric cylinders not served by the ES port. This packing cylinder unit has a plurality of concentric stages or cylinders which extend outwardly and retract in a telescoping fashion. Various internal valves may open and close as the various concentric cylinders extend and retract. However, for the purpose of explaining this invention, it is only necessary to understand that power fluid directed to the ES port operates to extend one or both of the two smaller concentric cylinders. Fluid directed to the E port directs fluid to all of the other concentric cylinders in the packing cylinder unit 10 that are not provided with power fluid from the ES port. If the packing cylinder unit had only two concentric cylinders, e.g., a small and a large concentric cylinder, the ES port would serve the small concentric cylinder (typically about 5½" diameter) and the E port would provide fluid to the large concentric cylinder (typically above 9¼" in diameter).

Power fluid for this system is provided by pump 14 which obtains its fluid from reservoir 30. The outlet of pump 14 is directed to a first or extend power conduit 15 which is provided with valve 32. This power conduit 15 is connected to a first extend branch conduit 16 and a second extend branch conduit 22. Conduit 16 is connected to port 33 and extend branch conduit 22 is connected to port 35. As can be seen the power fluid is directed to the port ES without any obstructions in the conduit. However, extend branch conduit 22 is provided with a sequence control valve 12. This valve 12 is normally closed and is opened only when the pressure in conduit 15 reaches a preselected value which is normally selected to be between about 800 and 1200 p.s.i. A conduit 26 connects into line 15 and senses the pressure so that when the pressure reaches the selected value, valve 12 is opened. When the valve 12 is opened, power fluid is then directed through second extend branch conduit 22 to the E port 35.

A retract conduit 24 with valve 34 is connected to the output of pump 14. When the device is in an extend position valve 34 is closed. Retract conduit 24 is connected to a conduit 50 with valve 52 which is connected to power fluid return conduit 40 for returning spent power fluid to storage 30. During the extend portion of the cycle, valve 34 is closed and valve 52 is opened.

Normal operation of this system begins with the cylinder fully retracted. The packer blade (not shown) will be in a stored position and there will be no pressure on either side of the packing cylinder unit. Sequence control valve 12 is set to have a selected pressure for opening, e.g., 800 to 1200 p.s.i. Valve 34 is closed. Valve 52 is open and valve 32 is open. The pump is started and immediately provides fluid through extend power conduit 18 and first extend branch 16 to port 33 to one of the two smallest extend concentric cylinders in the packing cylinder unit 10. (This small concentric cylinder is typically about 5½ inches O. D.) This small concentric cylinder will extend until it has reached full extension (typically about 48 inches) or until the pressure of the load causes the system pressure to rise to the pressure setting on the sequence valve. The speed at which this small rod extends depends upon the pump size and engine speed. If the sequence valve pressure setting has not been exceeded and the first small concentric cylinder has extended fully, then the other small concentric cylinder will start to extend. Internal valving sequentially provides power fluid to one of the smaller concentric cylinders and then the other in a typical five stage packing cylinder unit. This other small concentric cylinder will extend until it too is fully extended (which is about 48 inches typically) or until the sequence valve pressure setting is exceeded. As soon as the sequence valve 12 pressure setting has been reached, that valve opens and fluid immediately proceeds through the second extend branch conduit to the E port 35 to the large concentric cylinders. The concentric cylinders will continue to extend until the unit is fully extended or until the load stalls the hydraulic system.

When it is desired to retract the system, valve 32 in the extend power conduit 15 is closed and valve 34 in the retract conduit 24 is opened and valve 52 in conduit 50 which connects the retract conduit 24 to the power fluid return conduit 40 is closed. Power from the pump 34 is then directed to the R port 36 which causes the concentric cylinders to retract. I will now describe the flow diagram showing the path of the returned fluid. The extend branch conduit 16 is connected to a conduit 18 to a pressure operated check valve 20 and the return fluid from E port is through branch 22 to a pressure operated check valve 21 which is similar to valve 20. The outputs of these two check valves are connected through conduits 46 and 48 to a return power fluid line 40 which goes to storage 30. Check valves 20 and 21 are normally closed, however, they are of a type such that when the pressure in retract conduit 24 reaches a selected value then valves 20 and 21 open. This permits the return fluid from extend branch conduits 16 and 22 to be directed to line 40. A crossover or shunt conduit 42 is provided between lines 44 and 18. This line is provided with a check valve 38 which permits fluids to go only from line 44 to line 18. The reason for this valve is that normally the amount of fluid being returned through line 22 is greater than through line 16. Then the check valve 38 opens and permits fluid to flow into line 18 from branch line 22. Thus, this tends to balance the amount of fluid flowing through lines 18 and 44. For convenience, the sequence valves 12, pressure operated check valves 21 and 20 and check valve 38 and attendant flow lines can be called a sequence valve assembly 13. The packing cylinder unit is thus quickly returned to its retracted position.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What I claim is:

1. A fast sweep system for extending the telescopically extendable concentric cylinders of a packing cylinder unit and which packing cylinder unit has a retract port R an extent port ES for conducting power fluid to a small concentric cylinder and an E port for conducting fluid to a concentric cylinder which is larger than said small concentric cylinder which comprises:

a power fluid storage;

a power fluid source;

a first extend power conduit connected to the output of said power fluid source;

a first extend branch conduit extending from said first extend power conduit to said ES port;

a second extend branch conduit extending from said first extend power conduit to said E port;

a sequence valve within said second extend branch conduit, said valve being normally closed and operable to open when the pressure in said extend power conduit reaches preselected value;

a retract conduit extending from said power fluid source to said R port;

a first valve in said first extend power conduit;

a second valve in said retract conduit;

first connecting means to connect said retract conduit to said storage and having a valve therein;

a second connecting means for connecting said second extend branch conduit to said storage by way of a return conduit;

said second connecting means comprising, a first fluid return branch conduit connecting said second branch conduit with said return conduit;

a second fluid return branch conduit connecting said second extend power conduit to said return conduit;

a first and a second pressure operated check valve in said respective first fluid branch conduit and in said second fluid return branch conduit respectively;

means to open said first and second pressure operated check valve upon the pressure in said retract conduit reaching a predetermined value;

a shunt conduit connecting said first and second return branch and a check valve therein permitting flow of fluid only from said first to said second return branch conduits.

* * * * *